United States Patent [19]

Stern

[11] 4,450,034

[45] May 22, 1984

[54] LAMINATOR FOR LARGE WORKPIECES

[75] Inventor: Michael J. Stern, Chatsworth, Calif.

[73] Assignee: Atlantic Richfield Company, Los Angeles, Calif.

[21] Appl. No.: 387,100

[22] Filed: Jun. 10, 1982

[51] Int. Cl.[3] ..... B30B 15/34

[52] U.S. Cl. ..... 156/382; 100/211; 156/285; 156/583.3

[58] Field of Search ..... 156/382, 285, 286, 580, 156/583.3

[56] References Cited

U.S. PATENT DOCUMENTS

| | | | |
|---|---|---|---|
| 2,671,493 | 3/1954 | Olson | 156/285 X |
| 2,730,281 | 1/1956 | Prohaska | 100/211 X |
| 2,975,476 | 3/1961 | Burke | 100/211 X |
| 3,888,719 | 6/1975 | Gibbs | 219/243 X |
| 4,078,962 | 3/1978 | Krueger | 156/286 X |

*Primary Examiner*—David A. Simmons

*Attorney, Agent, or Firm*—Nilsson, Robbins, Dalgarn, Berliner, Carson & Wurst

[57] ABSTRACT

Apparatus for use in the fabrication of laminated products. A laminator includes lower and upper units, the lower unit adapted to receive a workpiece within a recessed interior cavity and the upper portion providing a hood thereover. An elastomeric membrane, which serves as a diaphragm for transmitting forces, is adhesively secured at the periphery of the upper unit. A peripheral rib structure associated with the lower unit is provided to assure air tight sealing of the vacuum chamber wherein lamination takes place. Ports in the upper and lower members are adapted to accept the outputs of air evacuation apparatus for controllably actuating the membrane to apply a compressive force over the surface of the workpiece during the lamination process.

2 Claims, 3 Drawing Figures

FIG. 1
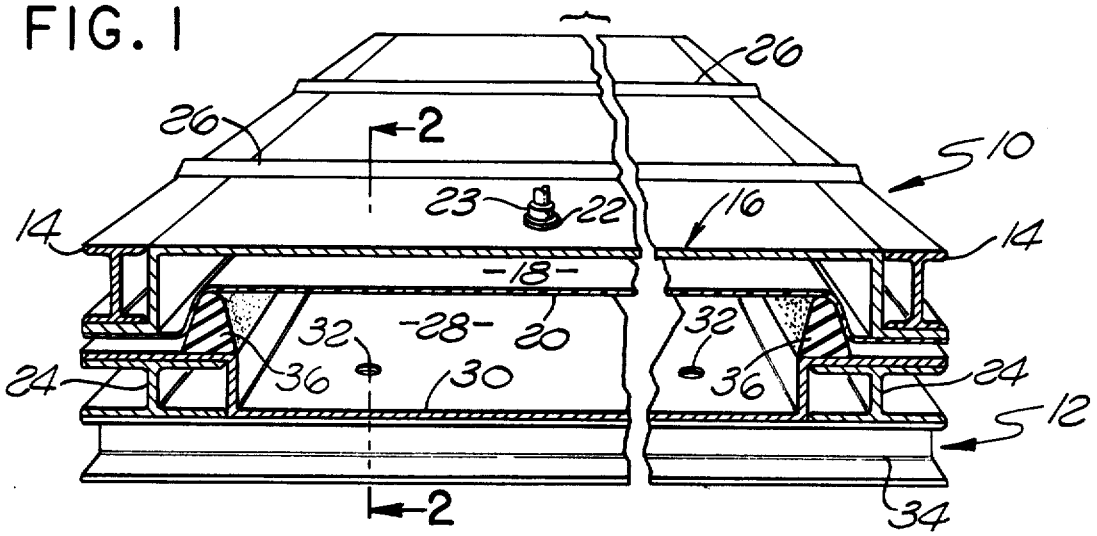
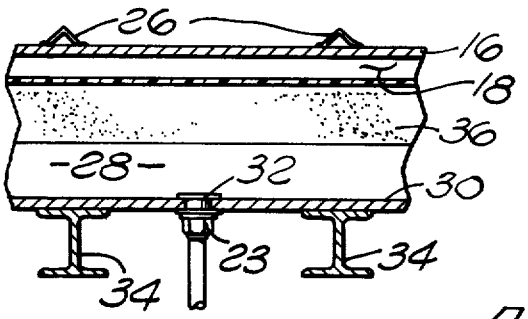
FIG. 2
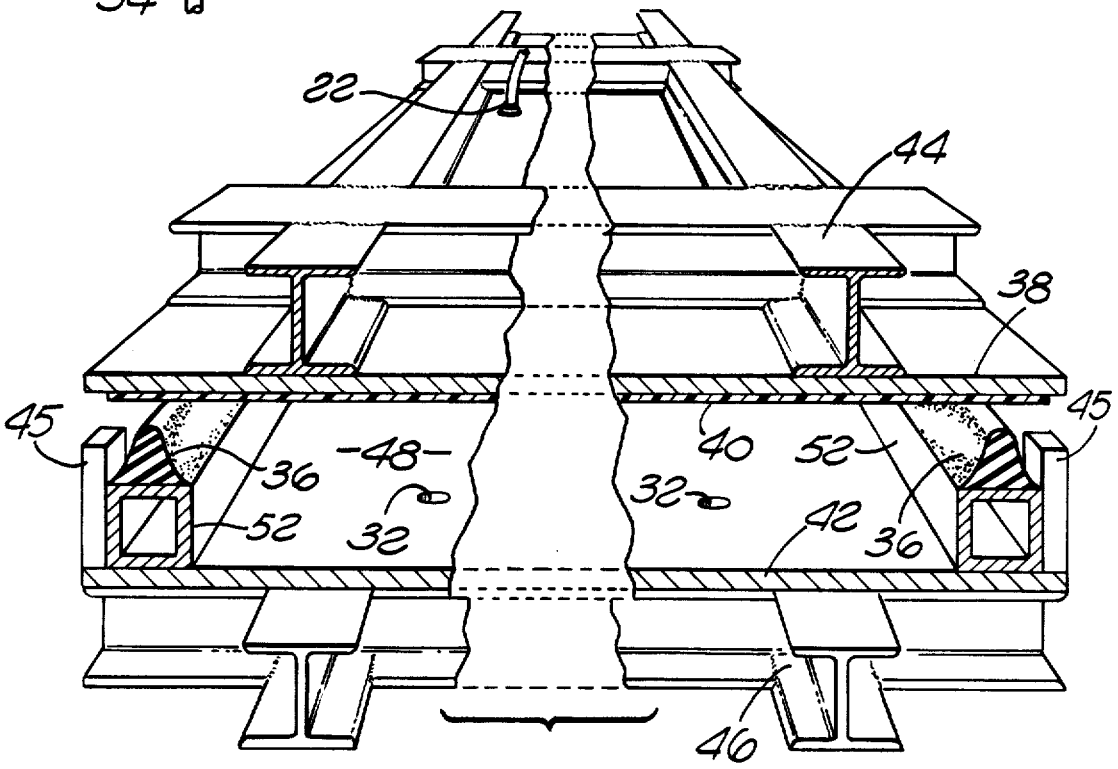
FIG. 3

LAMINATOR FOR LARGE WORKPIECES

BACKGROUND OF THE DISCLOSURE

1. Field of the Invention

The present invention relates to apparatus for use in lamination and/or encapsulation processes. More particularly, this invention pertains to durable apparatus of economical structure for the lamination of relatively large surface area workpieces.

2. Description of the Prior Art

In the lamination art pressure and heat must interact in preferred ways in a controlled environment to provide an acceptable product. Prior art lamination apparatus has often included, as means for applying pressure across the workpiece surface, an elastomeric membrane in conjunction with a vacuum pump or the like. By providing a sealable relationship between the membrane and an underlying base upon which the workpiece to be laminated is placed and thereafter evacuating air from beneath the membrane, atmospheric pressure (approximately 15 ps.i. at sea level) is exerted across the surface of the workpiece through the membrane. This principle and basic apparatus therefor are disclosed, for example, in U.S. Pat. No. 4,287,015 of Danner, Jr. for "Vacuum Bag Used in Making Laminated Products".

While the vacuum bag principle has been well accepted in the lamination and encapsulation arts, the realization of apparatus for the lamination of workpieces having relatively large surface areas, such as solar cell panels, introduces significant problems that are not experienced in the manufacture of smaller objects. The utilization of atmospheric pressure in combination with a vacuum to generate forces for the lamination of objects of relatively large surface areas submits the laminating apparatus which supports the workpiece to large stresses. This is due to the large surface area of the lamination apparatus necessarily required to accommodate the large workpiece. Thus, large area laminator design requires resistance to forces that can fatigue the apparatus itself and degrade the quality of laminated product.

Design is complicated by an accompanying requirement that the lamination apparatus be compatible with means for applying a suitable temperature profile to the workpiece before, during and, often, immediately after the lamination process. Both radiant and conduction heating are conventionally employed in conjunction with lamination processes, and, in accordance with the facilities of the user, such heating may be accomplished internal or external to the lamination apparatus. The application of heat from an external source may be accomplished by placing the lamination apparatus into an autoclave or other oven. A heat blanket provides an advantageous means for conduction heating of the workpiece. However, to be effective the lamination apparatus must provide a design whereby the blanket can be mounted adjacent the workpiece for efficient heating.

The careful control of workpiece temperature profile requires effective heat transfer through the apparatus which supports the workpiece. In the event that an external heat source is employed, a laminator having good heat transfer properties allows the workpiece to be heated with a minimal energy input. Achievement of an oftentimes-critical optimum cooling profile for the workpiece is enhanced when the surrounding structures do not include members having unnecessarily large masses that can function as heat storage and absorption areas.

Thus, the effective lamination of relatively large area workpieces has created a current need in the art for apparatus of sufficient strength to withstand considerable force without impairing heat transfer capabilities and other aspects essential to the lamination process.

SUMMARY OF THE INVENTION

The above and additional needs and problems of the prior art are addressed by the present invention wherein there is provided improved apparatus for use in making laminated products. The apparatus provides a lower unit, which includes a recessed interior cavity, for receiving a workpiece and an upper unit for providing a hood thereover. There is further provided means associated with the upper unit for applying a controllable downward-acting force over the surface of the workpiece. A peripheral rib provides a sealable relationship between said means and said lower unit so that the interior of said cavity is selectively rendered air tight. Means are adapted to accept forces for actuating the last-named means.

Apparatus according to the foregoing description provides an economical and easily fabricated modular structure for use in the fabrication of laminated or encapsulated products. A laminator as above described is suitable for and amenable to the application of heat, either internally by, for example, a heat blanket, or externally through the inclusion of the laminator within an oven. The structures embodied therein permit the application of an advantageous double vacuum to prevent, to a large extent, the formation of bubbles during the preliminary heating of the workpiece.

The foregoing features and advantages of the invention will become further apparent from the detailed description, with accompanying drawing figures, which follows. Characters are provided as a guide and index to the various features of the invention as disclosed in the description and drawings, like characters referring to like features throughout.

BRIEF DESCRIPTION OF THE DRAWINGS

FIG. 1 is a perspective view, partially broken to show the sectional configuration of a laminator in accordance with a first embodiment of the invention;

FIG. 2 is a cross-sectional view taken along the line 2—2 of FIG. 1; and FIG. 3 is a perspective view, similar to FIG. 1, of a laminator in accordance with a second embodiment of the invention.

DETAILED DESCRIPTION

FIG. 1 is a partial perspective view of a laminator in accordance with a first embodiment of the invention. The laminator generally comprises an upper unit 10 and a lower unit 12 which may be joined at matching edges by a hinge or like mechanism (not shown) and actuated to the substantially closed position of FIG. 1 by conventional means including hydraulic and/or pneumatic force-actuated mechanisms well know in the art. The view shown in FIG. 1 (and in FIG. 3) is sectional in nature. The apparatus shown therein is substantially symmetrical about an axis orthogonal to that of the illustrated views.

I-shaped beams 14, preferably of aluminum, form a frame about the upper unit 10 providing, by means of their upper and lower flanges, reinforcement at the periphery of an upper plate 16 having a generally (inverted) U-shaped cross section. The upper plate 16 includes a recessed interior portion forming an upper evacuation chamber 18, the bottom of which is bounded by a flexible diaphragm or membrane 20 of elastomeric material (preferably silicon rubber). The membrane 20 is secured to the edge of the aluminum plate 16 by means of an appropriate silicon rubber adhesive.

The top of the upper unit 10 includes at least one port 22 formed at the interior of the upper plate 16. An appropriate fixture 23 is provided for mating to a quick disconnect or like fixture to allow the upper evacuation chamber 18 to be releasably coupled to the output of conventional pumping apparatus (not shown) for drawing a vacuum inside the chamber 18. A plurality of elongated members 26 having angular cross-sectional shapes are welded across the top surface of the upper unit 10 to provide structural reinforcement for the relatively large surface at the recessed interior of the upper plate 16.

The lower unit 12 similarly contains an evacuation chamber 28 formed of the recessed interior of a lower plate 30 having generally U-shaped cross section. (The views of FIGS. 1 and 3 are of greatly exaggerated dimension. In practice the depth of the chamber 28 is about one and one-half inches while its surface may be substantially square with sides on the order of 52 inches.) A pair of ports 32, formed of apertures in the recessed interior portion of the lower plate 30, provide communication between the interior of the chamber 28 and pumping apparatus (not shown) for drawing a vacuum in the chamber.

A plurality of I-beams 24 forms a peripheral frame about the lower unit 12, providing support at the edge of the generally U-shaped lower plate 30 in the same manner in which the frame formed in the upper unit 10 by means of the I-beams 14 provides support or reinforcement at the edge of the upper plate 16. The flanges of the I-beams 24 are considerably broader than those of the I-beams 14 providing, at their inner portions, areas for fixing a molded elastomeric rib 36 along the lengths of the beams 24. The rib 36 thereby surrounds the evacuation chamber 28, elevating the height of the membrane 20 (allowing the lamination of a relatively-thick workpiece and/or the arrangement of heating apparatus within the chamber 28) and providing an air tight seal about the chamber 28 when the overall laminator including the upper unit 10 and the lower unit 12 is completely closed. When the laminator is moved to such closed position, the membrane 20 contacts the lower plate 30 at its edge overlying the upper flanges of the I-beams 24. The height of the rib 36 is such that, when the laminator is so closed, its top contacts the interior, recessed surface of the upper plate 16. Thus, the chamber 28 is rendered air tight when the laminator is closed. By assuring such reliable, air tight sealing, a vacuum may be quickly and controllably drawn in the evacuation chamber 28 during lamination so that the quality of the resultant product is assured.

Viewing FIG. 1 in conjunction with FIG. 2, a cross-sectional view sectioned along the line 2—2 thereof, one can see the support structure of the base of the evacuation chamber 28 in detail. The base, in conjunction with the lower plate 30, provides support for the workpiece and other structures that may be placed within the chamber 28 such as a flexible heat blanket and associated structures including a layer of insulating material, a teflon coated layer for contacting the workpiece and the like. The vacuum port 32 within the plate 30 is seen to be positioned between a parallel pair of I-beams 34 which form a portion of the base. In FIG. 2 the upper flanges of the beams 34 are clearly seen to add support and stiffness to the aluminum plate 30.

In operation, a workpiece is placed within the evacuation chamber 28. As mentioned above, the elevation of the membrane 20 by means of the encircling elastomeric sealing rib 36 allows the lamination of workpieces having a wide array of thicknesses. Generally, the workpiece is first heated for the purpose of achieving proper viscosity. The chamber 28 is evacuated prior to such initial heating to avoid the introduction of bubbles into the laminated product. The upper chamber 28 is also evacuated during the initial heating of the workpiece, forming a double vacuum within the laminator, as the application of pressure to the workpiece prior to appropriate "softening" is undesirable.

After softening has occurred, the port 22 is disconnected from the vacuum source and air is allowed to enter the upper chamber 18 at a preselected rate. An equilibrium is thereafter established between the surrounding environment and the interior of the upper chamber 18 and air flow through the port 22 is discontinued when the interior of the upper chamber 18 reaches atmospheric pressure, resulting in a downward-acting force of approximately 15 pounds per square inch normal to the surface of the workpiece. During the time that a vacuum is drawn in the interior chamber(s) of the laminator, severe stresses are exerted upon the recessed areas of the upper plate 16 and the lower plate 30. The resultant forces are approximately 15 pounds times the surface areas of the top of the upper chamber 18 and the bottom of the evacuation chamber 28 (in square inches), respectively. In the event that it is desired to laminate a solar cell module having dimensions of 4 feet by 4 feet, a laminator according to the present invention should be sized such that the top and bottom surfaces of the chambers 18 and 28 respectively are at least 52 inches by 52 inches. The provision of 15 pounds of atmospheric pressure per square inch across an area of such extent will result in the application of over 40,000 pounds of force thereto.

A laminator in accordance with Applicant's invention including a lower plate of ¾ inch aluminum welded to a base formed of 6 inch I-beams will sustain such loading without incurring harmful bending or other undesirable deformation. By undergoing no significant deformation over time, the workpiece is provided with a regular and stable platform to enhance the quality of the laminated product. During the period of time that the upper chamber 18 is evacuated (i.e. as the workpiece is initially softened), the recessed top surface of the upper plate 16 of the laminator experiences forces similar to that of the lower plate 30. By providing a plurality of parallel arrayed beams of angular cross section as reinforcement, the upper plate 16 likewise does not suffer noticeable deformation or fatigue when subjected to the forces inherent in the vacuum lamination of workpieces of relatively large surface area.

FIG. 3 is a partial perspective view of the present invention according to a second preferred embodiment This embodiment functions in like manner to that illustrated above. Unlike the former embodiment, however the upper plate is planar throughout as opposed to the substantially planar upper plate 16 of the embodiment of FIG. 1 which includes edge members rendering an (inverted) U-shaped configuration overall. Thus, a separate (upper) chamber is not formed between a diaphragm or membrane 40 (preferably of silicon rubber and adhesively bonded to the edge of the plate) and the upper plate 38.

The lower plate 42 is similarly planar throughout as opposed to the generally U-shaped lower plate 30, the substantially planar portion of which forms the bottom of the cavity 28 of FIG. 1. Both upper and lower plates are reinforced by criscrossing upper and lower patterns of orthogonal I-beams 44 and 46 welded to the upper and lower plates, respectively. As in the previously-described embodiment, ports 22 and 32 are shown to be associated with the upper plate 38 and the lower plate 42, respectively, provided means for communication with a vacuum pump (not shown). Alternatively, communication may be provided between vacuum sources and the interior of the laminator, both above and below the membrane 40, by means of milled air channels within plates 38 and 42.

The substantial reinforcement provided by the orthogonal I-beams above and below the upper plate 38 and lower plate 42, respectively, allows one to obtain support against the substantial forces described above while utilizing one-half inch aluminum plate, as opposed to the slightly thicker aluminum plate of the embodiment of FIG. 1. An evacuation chamber 48 is created between the membrane 40 and the lower plate 42. The sides of the chamber 48 are framed by a plurality of elongated aluminum blocks 45 (which serve as a "stop" during the closure of the upper and lower units of FIG. 3) and elongated beams 52 of boxlike cross-section welded thereto throughout their lengths. The tops of the beams 52 provide surfaces for affixing the molded elastomeric rib 36 that provides a peripheral seal between the upper and lower units as in the embodiment of FIG. 1.

Thus, it is seen that there has been brought to the lamination and encapsulation art new and improved apparatus for use in conjunction with large area workpieces. The apparatus as disclosed is able to withstand the large forces of deformation inherent in the lamination of large area workpieces such as solar cell panels while providing a structure of uncomplicated design, ease of maintenance and economy of both fabrication and use. By utilizing strong reinforcing elements of relatively limited mass, such as I-beams and other substantially hollow structures fabricated of aluminum, a good conductor of heat, efficient heat transfer is achieved. The use of vacuum ports both above and below the diaphragm or membrane, allows the drawing of a controllable double vacuum within the laminator, further enhancing the quality of the resulting product by minimizing the introduction of bubbles.

While the invention has been described in connection with preferred embodiments, it will be understood that it is not limited to the particular embodiments disclosed. Rather, it is intended to encompass all alternatives, modifications and equivalents which may fall within the scope of the appended claims.

What is claimed is:

1. Apparatus for use in making laminated products comprising:

(a) a lower plate unit for receiving a workpiece and having a first offset peripheral edge porition and being of generally U-shaped cross section and having a recessed substantially planar interior and terminating with an outwardly extending continuous peripheral flange portion and a plurality of elongated members forming frames about the periphery of said lower plate unit secured to said flange portion for reinforcing the edge portion of said generally U-shaped lower plate;

(b) an upper plate unit for providing a hood over said lower unit and having a second offset peripheral edge portion and being of generally U-shaped cross section and having a recessed substantially planar interior and terminating with an outwardly extending continuous peripheral flange portion and a plurality of elongated members forming frames about the periphery of said upper unit secured to said flange portion for reinforcing the edge portion of said generally U-shaped upper plate;

(c) flexible diaphragm means disposed between said upper and lower plate units and defining upper and lower chambers;

(d) adhesive means for securing said diaphragm means to the peripheral edge of said upper plate unit;

(e) said first and second peripheral edges being in abutting relationship with said diaphragm therebetween when said upper and lower plate units are closed;

(f) a peripheral rib of molded elastomeric material for providing a peripheral sealable relationship between said diaphragm means and said upper and lower plate units so that said chambers may be rendered air tight; and (g) evacuating means for evacuating said upper and lower chambers.

2. Apparatus as defined in claim 1 further including:

(a) means for reinforcing said lower and upper plates;

(b) said means for reinforcing said lower plate comprises a first plurality of orthogonally-arrayed elongated members secured to a surface of said lower plate external of said lower chamber; and (c) said means for reinforcing said upper plate comprises a second plurality of orthogonally-arrayed elongated members secured to a surface of said upper plate external of said upper chamber.

* * * * *